United States Patent [19]

Frost et al.

[11] Patent Number: 4,748,378

[45] Date of Patent: May 31, 1988

[54] IONIZED CHANNEL GENERATION OF AN INTENSE-RELATIVISTIC ELECTRON BEAM

[75] Inventors: Charles A. Frost; Gordon T. Leifeste; Steven L. Shope, all of Albuquerque, N. Mex.

[73] Assignee: The United States of America as represented by the Department of Energy, Washington, D.C.

[21] Appl. No.: 846,530

[22] Filed: Mar. 31, 1986

[51] Int. Cl.[4] ..... H01J 7/46; H01J 19/80

[52] U.S. Cl. ..... 315/39; 315/4; 315/5; 315/5.41; 328/233

[58] Field of Search ..... 315/3, 4, 5, , 5.41, 315/5.42, 39; 328/233

[56] References Cited

U.S. PATENT DOCUMENTS

| | | | |
|---|---|---|---|
| 3,191,092 | 6/1965 | Baker et al. | 315/111.61 |
| 3,916,239 | 10/1975 | Friedlander | 328/233 |
| 4,038,602 | 7/1977 | Friedman | 328/233 |
| 4,143,299 | 3/1979 | Sprangle | 315/5.42 |
| 4,150,340 | 4/1979 | Kapetanakos et al. | 315/3 |
| 4,345,220 | 8/1982 | Sullivan | 315/39 |
| 4,553,068 | 11/1985 | Brandt | 315/5 |
| 4,583,025 | 4/1986 | Adler et al. | 315/4 |
| 4,608,537 | 8/1986 | Mako et al. | 328/233 |
| 4,656,430 | 4/1987 | Olson | 315/5 |

*Primary Examiner*—Saxfield Chatmon

*Attorney, Agent, or Firm*—George H. Libman; James H. Chafin; Judson R. Hightower

[57] ABSTRACT

A foilless intense relativistic electron beam generator uses an ionized channel to guide electrons from a cathode passed an anode to a remote location.

10 Claims, 2 Drawing Sheets

IONIZED CHANNEL GENERATION OF AN INTENSE-RELATIVISTIC ELECTRON BEAM

The U.S. Government has rights in this invention pursuant to Contract DE-AC04-76DP00789 between the U.S. Department of Energy and AT&T Technologies, Inc.

BACKGROUND OF THE INVENTION

This invention relates generally to a diode for generating an Intense Relativistic Electron Beam (IREB), and more particularly to a foilless diode that uses an ionized channel to generate an IREB.

IREB's are short (10's of nanoseconds) pulses of very high voltage (MeV) and high current (10k's of Amperes) electrons. They are useful for radiography, laser pumping, microwave generation, beam propagation and basic physics research, etc.

All IREB generators have a cathode for generating the high power electrons towards an anode. Prior art generators either have a large magnet for focussing the electrons away from the anode and into a beam, or a thin metal foil for diverting the electrons from the anode, permitting them to pass down the channel. Additional information on these generators is provided by R. B. Miller, *An Introduction to the Physics of Intense Charge Particle Beams,* Plenum Press, New York, 1982.

The use of magnets makes the IREB generator large and expensive, and the magnetic field gives the beam angular mosentum that causes an undesirable rotation of the IREB.

The use of a foil in the generator enables the magnets to be removed, but introduces a short circuit in the radial electric field causing an undesirable increase in the electron velocity perpendicular to the desired direction of the electron beam.

It is known that when an electron beam is injected into a preionized channel, the beam space charge ejects plasma electrons, leaving an ion core which electrostatically attracts electrons to the ion channel.

D. S. Prono, et al., Electron-Beam Guiding and Phase-Mix Damping by Electrostatically Charged Wire, Physical Review Letters, Vol. 51, No. 9, Aug. 29, 1983, pp. 723–726, discusses two experiments where a positive line charge was formed along a charged graphite wire supported on graphite foils. Prono's beam was generated in a conventional manner, accelerated and transported magnetically to the experiment. Prono found the charged wire to focus and damp the beam along the wire.

W. E. Martin, et al., Electron-Beam Guiding and Phase-Mix Damping by a Laser-Ionized Channel, Physical Review Letters, Vol 54, No. 7, Feb. 18, 1985, pp. 685–688, reported the use of a laser-ionized channel for relativisitic electron beam guiding, focusing and damping. They found the channel radius should be smaller than the beam radius for the radial focusing force to be anharmonic and thereby lead to desirable phase-mix damping of the transverse beam motion. They also found the electron beams density should be greater than the channel-ionization density to prevent instability. They used a conventional source to generate their IREB.

SUMMARY OF THE INVENTION

It is an object of this invention to provide a foilless, mangetless, diode for generating an IREB.

It is another object of this invention to provide a diode using an ionized channel to guide an IREB from a cathode.

Additional objects, advantages and novel features of the invention will become apparent to those skilled in the art upon examination of the following description or may be learned upon practice of the invention. The objects and advantages of the invention may be realized and attained by means of the instrumentalities and combinations particularly pointed out in the appended claims.

To achieve the foregoing and other objects in accordance with the purpose of the present invention, as embodied and broadly described herein, the IREB generator consists of a cathode for generating a pulse of high energy electrons and an anode for attracting the electrons from the cathode. An ionizable gas extends from the cathode to a remote location, and means are provided for forming a strongly ionized channel of a radius not larger than the radius of the electron beam extending from the cathode to the remote location. The invention further includes a method for generating an IREB consisting of forming a strongly ionized channel extending from a cathode to a remote location, and generating a pulsed beam of high energy electrons form the cathode along the channel, the channel having a radius not larger than the radius of the beam. In operation, the low energy electrons in the ionized channel are expelled from the channel by the high energy electrons from the beam, leaving a positive core of ions which attract and guide the beam by partially neutralizing the space charge of the IREB, resulting in a self-generated, focusing, magnetic field.

DETAILED DESCRIPTION OF THE INVENTION

Figure 1:
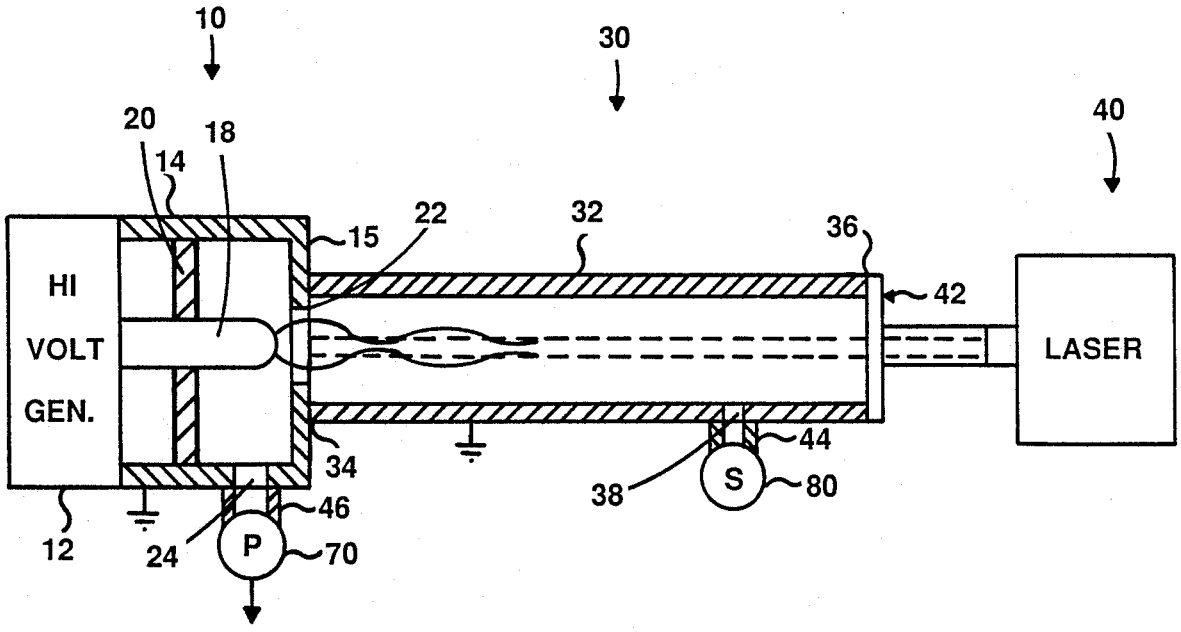
FIG. 1 is a schematic representation of an embodiment of the invention.

FIG. 1 shows a conventional IREB generator 10 connected to a chamber 20 containing a gas preionized by laser 40.

IREB generator 10 includes high voltage generator 12, a tubular anode 14 extending at one end from generator 12 to an opposing end sealed by end plate 16. Cylindrical cathode 18, having a radius $r_c$, extends from generator 12 coaxial to, and thereby forming a transmission line with, anode 14. Each of anode 14 and cathode 18 may conveniently be formed from stainless steel or graphite. A dielectric insulator 20 may be used to maintain the spacing between anode and cathode.

End plate 16 is provided with an annular opening 22 having a radius $r_a$ and aligned with cathode 18. Most electrons released from cathode 18 would move radially without the influence of anode 14. However, in this embodiment, electrons move toward the metal edge of opening 22, the part of anode 16 closest to cathode 18. This construction imparts movement to the electrons in a direction towards the output of the generator.

In operation, high voltage generator 12 applies a pulse to cathode 18 having a negative potential with respect to grounded anode 14 of approximately one million volts. If no other structure is provided, the electrons short out on anode 14. However, if means are provide for directing the electrons through opening 22, an IREB will be generated.

A conventional, prior art, generator might have a thin metal foil extending across opening 22. Electrons from cathode 18 would be attracted to the closer foil and, because of the thinness of the foil and the extremely high potential of the electrons, pass through. The foil would typically be destroyed by each shot of high current density beam, and require time-consuming replacement between shots.

Alternatively, a prior art generator sight have a large magnet (e.g. 20 kG) situated around the output of anode 14 to guide the electrons along a desired path.

This invention provides an IREB without the fragile foil or the large expensive magnet. As shown, output chamber 30 includes a tube 32 having one end 34 vacuum sealed and electrically connected to end plate 16 and an opposing end 36 at a remote location. The radius of tube 32 at end 34 is greater than the radius $r_a$ of aperture 22, enabling end 34 to surround aperture 22, thereby connecting the interior of tube 32 with the interior of anode 14. These interiors are filled with an ionizable gas as described hereinafter.

The invention further includes means for ionizing the gas within chamber 30. In the present embodiment, the output of laser 50 is aimed at cathode 18 through window 42 at remote location 36 of chamber 30. When activated, laser 50 will ionize the gas within chamber 30 as described by Martin et al.

In order to successfully guide a beam in the ion focused regime (IFR) mode, sufficient channel ionziation must be provided to overcome beam space charge expansion; or $f_e$ must be greater than $\gamma^{-2}$, where $f_e$ is the ratio of channel to beam linear charge density and $\gamma$ is the Lorenz factor. In addition, $f_e$ must be less than one, or excess plasma electrons will remain in the channel to form a destabilizing return current leading to violent instability and rapid ejection of the beam from the channel. However, since beam-induced ionization will cause $f_e$ to grow during the beam pulse to exceed one, very low gas pressure in chamber 30 is required.

If the foregoing conditions are met by proper sizing of the components and choice of materials, the output of laser 50 will ionize a channel to aperture 22 in anode end plate 16. When IREB generator 10 is fired, the beam will be injected into the channel formed by laser 50 in the gas in chamber 30. The beam space charge ejects plasma electrons leaving an ion core, and the beam electrons are electrostatically attracted to the ion channel.

If the radius of the ionized channel $r_c$ is not greater than the radius of the IREB $r_b$, as Martin et al. and Prono et al. showed, the radial focusing force will be anharmonic leading to phase-mix damping of transverse beam motion. In other words, the beam will follow the ionized channel and unwanted perturbations in the beam will be damped out.

In the foregoing description, $f_e = n_c r_c^2 / n_b r_b^2$ where $n_c$ and $n_b$ are the ion density (from the cathode) and beam density (in tube 32), respectively.

The correct gas and pressure is critical for this device to operate. The gas pressure must be great enough in chamber 30 to ionize in accordance with specific criteria, but it must be low enough around cathode 18 and anode 14 not to ionize, as ionization in that location would short circuit the electrons from cathode 18 to anode 14.

In applicants' invention, proper gas pressure is obtained by having a source 60 of gas connected through conventional valves (not shown) and conduit 44 to an aperture 38 in the wall of chamber 30. Gas is exhausted by a pump 70 connected through conduit 46 to an aperture 24 in anode 14. Aperture 22 in end plate 16 is sized to create a sufficient pressure differential between the interior of anode 14 and the interior of chamber 30 whereby laser 50 ionizes the gas in chamber 30 but does not ionize the gas in anode 14.

Figure 2:
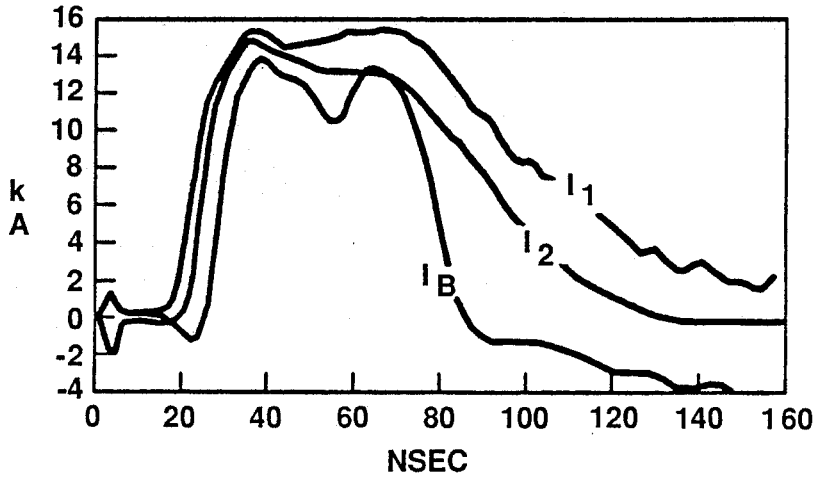
FIG. 2 shows the current transported by the embodiment of FIG. 1.

FIG. 2 shows experimental results with this invention. In this experiment, the cathode 18 was a bullet-shaped graphite rod having a diareter of 1 cm and end plate 16 was a 0.6 cm thick graphite plate having an aperture 22 diameter of 2 cm. The diameter of stainless steel anode 14 was 20 cm. Stainless steel tube 32 was 1 m long and had an inside diameter of 10 cm. Chamber 30 was filled with diethylaniline (DEA) provided as a liquid at source 60. Pressure of the evaporating DEA was maintained at a pressure of 0.2 to 1.0 mTorr in chamber 30 and at a lower pressure of 0.1 to 0.5 mTorr within anode 14 by pump 70. The DEA was ionized by 2 step photoionization with a 100 mJ, 266 nm, 10 ns laser (4th harmonic Nd:YAG) 100 ns before high voltage generator 12 was fired.

Three curves are seen in FIG. 2. The curve labeled $I_1$ was measured with a Rogowski current monitor mounted approximately 5 cm down tube 32 from end plate 16. The curve labeled $I_2$ was measured with another Rogowski current monitor at end 36 of tube 32. The curve labeled $I_b$ was measured with the beam current sonitor of Ser. No. 670,777, filed Nov. 13, 1984 and assigned to the assignee of this invention.

Curves $I_1$ and $I_2$ show the total beam plus plasma currents at their respective locations. Curve $I_b$ shows the beam current at end 36 to be approximately 14 kA for a 1 MeV, 50 ns beam. The correlation between $I_b$ and $I_2$ shows that the beam current is accurately represented by the first 80 ns of $I_1$.

Figure 3:
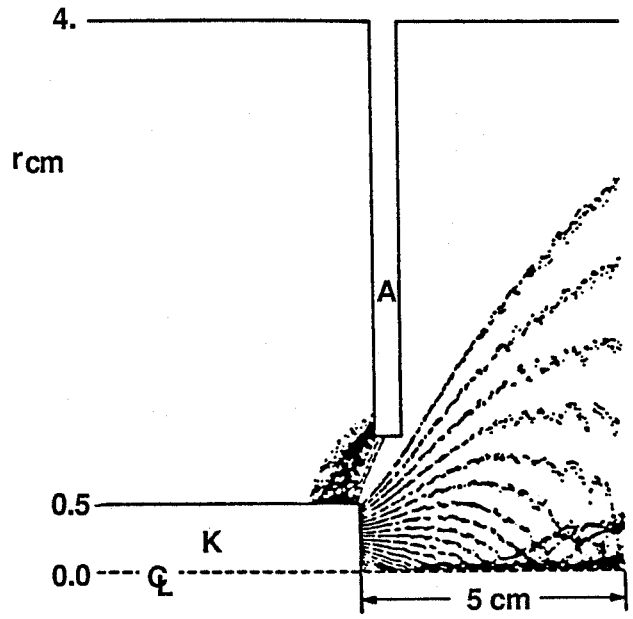
FIG. 3 shows a simulation of the embodiment of FIG. 1 under partial ionization.
Figure 4:
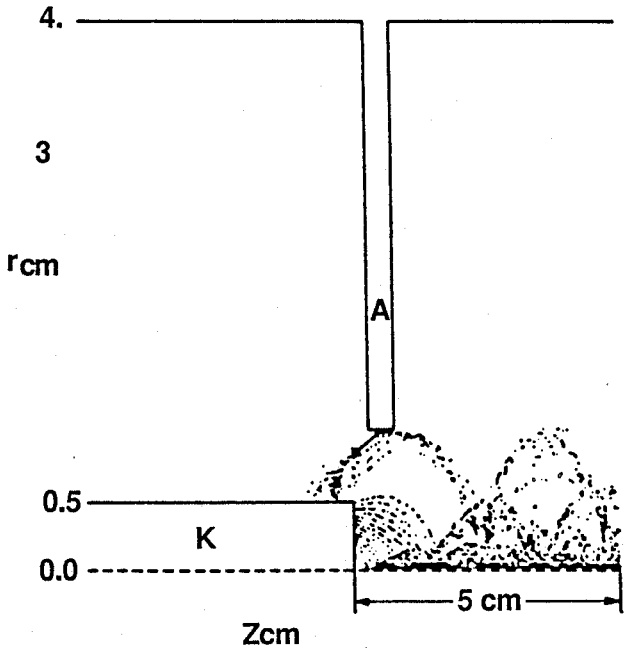
FIG. 4 shows a simulation of the embodiment of FIG. 1 under strong ionization.

FIGS. 3 and 4 show computer simulations of electron distribution near the cathode K and anode A under different channel ionization conditions. These simulations were made with the 2-D MAGIC particle code described in MRC Report MRC/WDC-R-068, September 1983.

FIG. 3 shows most electrons emitted from cathode K flow directly to anode A in a weakly ionized channel ($n_c = 8 \times 10^{11}$ cm$^{-3}$). The calculated axial current along the channel is only about 5 kA for a 1 MeV applied voltage.

FIG. 4 shows the improvement when the channel is strongly ionized ($n_c = 8 \times 10^{12}$ cm$^{-3}$). Fewer electrons flow directly towards anode A; most electrons being directed axially along the channel. The calculated current for a 1 MeV applied voltage for this simulation was a 1.2 cm, 15 kA beam; close agreement with the 1 cm, 14 kA beam actually measured.

It should be noted that a channel is strongly ionized when the conditions discussed above, $1 > f_e > \gamma^{-2}$, are met.

The particular sizes and devices discussed above are cited merely to illustrate a particular embodiment of the invention. It is contemplated that the use of the invention may involve different materials, configurations and sizes as long as the principal, using an ionized channel to capture an electron beam near a cathode to provide an IREB, is followed. It is intended that the scope of the invention be defined by the claims appended hereto.

We claim:

1. A method for generating an intense relativistic electron beam consisting of:

forming a strongly ionized channel containing positive ions and electrons, said channel having radius $r_c$ and extending from adjacent a cathode to a remote location; and generating a pulse of high energy electrons from said cathode to said remote location along said channel, said electrons having a radius $r_b >= r_c$, whereby low energy electrons in the ionized channel are expelled by the high energy electrons leaving a positive core of ions which attract and guide the high energy electrons by partially neutralizing the space charge of the IREB, resulting in a focusing magnetic field.

2. A foilless diode for generating an intense relativistic electron beam without a strong external magnetic field consisting of:

high voltage pulse generating means for generating a very high voltage pulse;

cathode means, connected to said pulse generating means, for generating a pulse of high energy electrons having a radius $r_b$;

anode means, connected to said pulse generating means and spaced from said cathode means, for attracting said high energy electrons from said cathode;

an ionizable gas extending from adjacent said cathode to a remote location;

means for generating an ionized channel of radius $r_c <= r_b$ through said ionizable gas from adjacent said cathode to said remote location, said channel not intersecting said anode and satisfying the following relationship:

$$1 > f_e > \gamma^{-2}$$

wherein $f_e = n_c r_c^2 / n_b r_b^2$ and $n_c$ is the ion density, $n_b$ is the beam density, and $\gamma$ = the Lorenz factor.

3. The foilless diode of claim 2 wherein said cathode means includes an elongate rod aligned with, and having an end facing, said ionized channel; and said anode means includes an anode plate adjacent said cathode end, said anode plate having an aperture aligned with said plate and said channel, the radius of said aperture being larger than $r_b$.

4. The foilless diode of claim 3 wherein said anode means further comprises a cylinder extending coaxially with said cathode from said anode plate to said high voltage generating means.

5. The foilless diode of claim 4 further comprising a chamber extending from said anode plate to said remote location, the interior of said chamber being open to the interior of said anode cylinder through said plate aperture, said ionizable gas being contained within said chamber and said anode.

6. The foilless diode of claim 5 wherein said chamber is a tubular waveguide having a window.

7. The foilless diode of claim 6 further including:

a source of ionizable gas connected to said waveguide near the remote location, and pump means, connected to said anode means, for controlling the pressure of the gas.

8. The foilless diode of claim 7 wherein said means for generating an ionized channel comprises a laser aligned through said window with the interior of said waveguide.

9. The foilless diode of claim 8 wherein said ionizable gas is diethylaniline at approximately 0.2 to 1 mTorr pressure along the channel and a lower pressure in the range of approximately 0.1 to 0.5 mTorr near the cathode.

10. The foilless diode of claim 9 wherein said laser is a 100 mJ, 266 nm, 10 ns, Nd:YAG, and $r_{cs} = 1$ cm.

* * * * *